United States Patent [19]

O'Neill

[11] 4,325,340

[45] Apr. 20, 1982

[54] VARIABLE PRESSURE FUEL INJECTION SYSTEM

[75] Inventor: Cormac G. O'Neill, Walnut Creek, Calif.

[73] Assignee: The United States of America as represented by the Secretary of the Army, Washington, D.C.

[21] Appl. No.: 170,387

[22] Filed: Jul. 21, 1980

[51] Int. Cl.[3] ..... F02M 39/00

[52] U.S. Cl. ..... 123/447; 123/457

[58] Field of Search ..... 123/447, 457–465

[56] References Cited

U.S. PATENT DOCUMENTS

| | | | |
|---|---|---|---|
| 2,986,881 | 6/1961 | Moore | 123/447 |
| 3,789,818 | 2/1974 | Asbery et al. | 123/447 |
| 3,818,882 | 6/1974 | Leonov et al. | 123/447 |
| 3,927,652 | 12/1975 | O'Neill | 123/457 |
| 3,943,901 | 3/1976 | Takahashi et al. | 123/447 |
| 4,069,800 | 1/1978 | Kanda et al. | 123/447 |
| 4,142,497 | 3/1979 | Long | 123/460 |

FOREIGN PATENT DOCUMENTS

| | | | |
|---|---|---|---|
| 638537 | 6/1950 | United Kingdom | 123/447 |

*Primary Examiner*—Ira S. Lazarus
*Assistant Examiner*—Magdalen Moy
*Attorney, Agent, or Firm*—Peter A. Taucher; John E. McRae; Nathan Edelberg

[57] ABSTRACT

A fuel injection system wherein the fuel pressure can be varied or adjusted in accordance with different engine loading conditions. The system includes an accumulator and a source of high-pressure gas for raising the accumulator pressure in accordance with step increases in the fuel pressure. A pressure-operated piston valve is provided to communicate the accumulator with the gas pressure source or with an atmospheric vent, as necessary to raise or lower the accumulator pressure.

6 Claims, 1 Drawing Figure

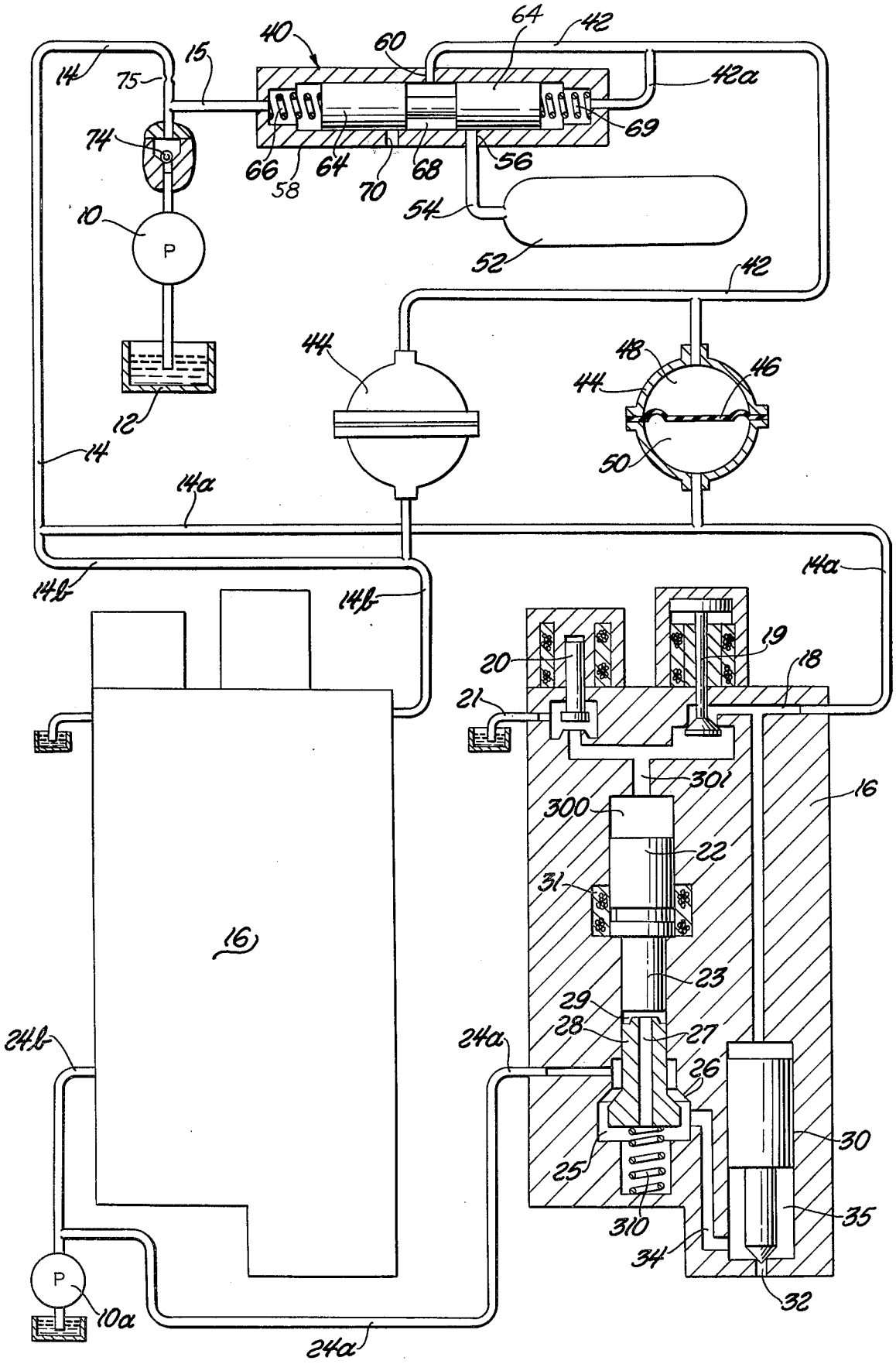
40
60
64
42
42a
14
15
75
74
69
66
58
64
70
68
56
54
10
P
52
42
44
48
46
44
12
14
50
14a
14b
14b
14a
20
19
18
21
301
16
300
22
31
16
23
29
28
27
24b
24a
26
30
25
310
35
34
32
P
10a
24a

VARIABLE PRESSURE FUEL INJECTION SYSTEM

The invention described herein may be manufactured, used, and licensed by or for the Government for governmental purposes without payment to me of any royalty thereon.

BACKGROUND AND SUMMARY

Known engine fuel injection systems include accumulators for minimizing pressure variations in the fuel pressure at the injectors. Some fuel injection systems include controls for varying the fuel pressure. In such systems it is necessary that the accumulator pressure be varied in accordance with fuel pressure variations so that the accumulator can continue to perform its function as a source of immediately available energy. In known systems employing a closed gas-volume accumulator, the gas pressure is changed by adding or withdrawing a volume of fuel sufficient to displace a piston or diaphragm to compress or expand the gas. As a result, not only does gas volume change, altering the characteristics of the accumulator, but, if rapid pressure changes are involved, the fuel required to compress the gas must be supplied at a high flow rate requiring that the supply pump respond to the instantaneous demand rather than average demand, thus to some extent negating the storage advantage of the accumulator.

My invention provides a means for adding or withdrawing gas to the accumulator in proportion to the changes in fuel pressure, thus holding the volume of fuel in the accumulator constant and avoiding additional burden on the supply pump. It includes a floatable valve element for alternately communicating the accumulator with a source of high gas pressure or an atmospheric vent, to raise or lower the accumulator pressure in accordance with step changes in fuel pressure. The valve is operated by pressure signals from the fuel system and accumulator.

THE DRAWINGS

The single FIGURE of the drawing schematically illustrates an engine fuel injection system embodying my invention, said system including a high pressure fuel pump 10 driven by the engine to pump liquid fuel from tank 12 to a pump output line 14, said output line having a series of branch lines 14*a*, 14*b*, etc. at each cylinder of the engine; only two branch lines are shown. Each branch line delivers high-pressure liquid fuel to a fuel injector 16 for the individual engine cylinder.

My invention is not concerned with the structure of the fuel injector per se. However, for illustration purposes I show one of the injectors constructed generally similar to the injector shown in my U.S. Pat. No. 3,927,652. The injector comprises two electrically-operable valves 19 and 20 that control liquid flow from supply line l4*a* to drain 21. A low pressure pump 10*a* delivers liquid fuel through line 24*a* to a chamber 25 that includes a valve seat 26 cooperable with a slidable spill valve 28. Fuel flows upwardly through hole 27 in valve 28, driving pistons 23 and 22 upwardly to displace liquid fuel from chamber 300 into passage 301, thence out through valve 20. A piston position sensor coil 31 continually monitors the displacement of piston 23; when piston 23 is at a location corresponding to a desired liquid volume in subjacent chamber 29 an electrical impulse is generated to close valve 20. Chamber 300 is now closed to act as a hydraulic lock preventing further upward displacement of pistons 22 and 23, and allowing valve 28 to close against seat 26 under the action of spring 310. At the appropriate time in the engine cycle designated for injection an electrical signal is generated to open valve 19, thereby communicating chamber 300 with supply pressure at passage 18. The relatively high supply pressure hydraulically drives pistons 22 and 23 downwardly to appreciably increase the pressure in chamber 29, according to the area ratio of pistons 22 and 23. Chamber 29 liquid is directed downwardly through hole 27 and passage 34 into space 35 below the large diameter section of injector nozzle valve 30, raising said valve against the pressure existing in passage 18; high pressure liquid is discharged through fuel injector orifice 32 to the combustionn chamber, not shown. The downwardly moving piston 23 contacts valve 28, thereby moving same away from seat 26 and causing collapse of injection pressure at orifice 32; the relatively high pressure condition in passage 18 then closes valve 30 against orifice 32. With valves 19 and 20 returned to their original positions the passage 18 pressure is isolated from chamber 300, which is then at drain pressure. Upward displacement of pistons 23 and 22 starts again under the action of the pressure supplied through line 24*a* . It will be understood that the various fuel injectors in the system are electrically programmed so that liquid fuel pulses are delivered in proper sequence to the individual combustion chambers as they are compression-charged with combustion air.

High pressure pump 10 is a variable displacement pump programmed to pressurize liquid line 14 to different pressure values in accordance with different loadings or power requirements imposed on the engine, e.g. high acceleration mode or uphill operation, level terrain operation, downhill operation, etc. In general, higher engine loading requires a relatively high pressure in line 14, for example 5,000 p.s.i., whereas a lower engine loading requires lower pressure in line 14, for example 2,500 p.s.i. The electrical control mechanism for varying the pump 10 displacement and resultant pressure in line 14 is not part of the present invention.

The present invention is directed to a pressure-operated valve means 40 having a conduit 42 connected to a series of accumulators 44, one for each injector 16 or pair of injectors. Each accumulator includes an internal membrane 46 subdividing the accumulator volume into a gas chamber 48 and a fuel chamber 50. The two chambers are normally at the same pressure so that membrane 46 occupies an intermediate position as shown in the drawing. Chamber 48 is initially pressurized from a thick-walled bottle or pressure source 52 for an inert gas such as nitrogen. The pressure source includes a conduit 54 that defines a gas pressure port 56 in a stationary valve housing 58. A central port 60 in housing 58 conducts high-pressure gas through conduit 42 to each chamber 48 when the piston valve 64 is displaced to the right from its illustrated position. Rightward displacement of piston 64 is obtained by high fuel pressure transmitted through line 15 to the left end face of the piston. As gas chamber 48 becomes pressurized the increased pressure is transmitted back through branch line 42*a*, thereby displacing piston 64 leftwardly toward its illustrated position. Eventually, the pressures in chambers 48 and 50 will be equalized with valve element 64 in its illustrated position; the pressures in lines 42*a* and 15 will center the valve so that port 60 is isolated from gas pressure port 56 and atmospheric vent port 70.

As injectors 16 operate in their normal fashion, without change in pump 10 displacement, the line 14 pressure will tend to periodically increase or decrease in accordance with fuel exhausted from the system through each drain line 21, balanced against the fuel added to the system by pump 10. Accumulators 44 react to momentary pressure surges in line 14 to smooth out those surges without permitting piston valve 64 to uncover ports 56 or 70. In this connection, it should be noted that ports 56 and 70 are spaced apart a greater distance than the axial length of annular groove 68 so that central port 60 remains isolated from ports 56 and 70 even in the presence of slight cyclic motions of the piston 64. Preferably, compression springs 66 and 69 are arranged between each end of the piston and the corresponding end of housing 58 to assist in stabilizing the piston position. As the piston moves to compress one of the springs it increases the reaction force of that spring and simultaneously reduces the force of the other spring because the one spring contracts and the other spring lengthens; this tends to stabilize the piston in the presence of minor pressure surges in line 14. The stabilizing effect is related to the force and rate of each spring. Each spring has the same force and rate.

Valve 64 comes into play when the pump 10 displacement is changed to provide a step change in the line 14 pressure, e.g. from 2,500 p.s.i. to 5,000 p.s.i., or vice versa. Under these conditions the pressures in lines 15 and 42*a* become temporarily unbalanced so that piston valve 64 is moved to connect central port 60 with port 56 or port 70, thereby pressurizing or depressurizing chamber 48 to an equivalency with the line 14 pressure.

The invention provides a means for automatically changing the mass of gas in the accumulator in response to step changes in the fuel line 14 pressure, without making any change in accumulator pressure in response to minor surges in line 14(*a* ) pressure. The system responds automatically to positive changes in the differential between fuel line pressure and gas chamber 48 pressure, and also to negative changes in the pressure differential (i.e. where the fuel pressure is below the chamber 48 pressure.). It is important for best operation that line 15 be connected to line 14 at a point relatively close to pump 10 because the system operates only as a result of the pressure drop in line 14 when, in a transient condition, pump 10 attempts to provide additional fuel to chambers 50. If it is not possible to connect line 15 to line 14 at a point close to pump 10, then a flow-restricting orifice 75 may be inserted in line 14 downstream from the connection junction with line 15. This orifice will generate a larger pressure difference on increasing fuel flow rates than the friction resistance of line 14 alone and will assist the ability of the system to anticipate pressure changes in line l4*a* . Chambers 50 and 48 are always at the same pressure, separated only by a thin diaphragm. A check valve 74 may be provided at the pump 10 outlet to keep the high pressure system pressurized when the engine is turned off.

I wish it to be understood that I do not desire to be limited to the exact details of construction shown and described for obvious modifications will occur to a person skilled in the art.

I claim:

1. An engine fuel injector system comprising a liquid fuel pump constructed to produce a variable delivery pressure in the pump output line; individual electrically-programmed fuel injectors connected to the pump output line for delivering fuel pulses to the engine combustion chambers; a gas pressure source; a hollow accumulator having a membrane therein subdividing the accumulator volume into a gas chamber and a fuel chamber; valve means alternately communicating the accumulator gas chamber with the gas pressure source or atmosphere, said valve means normally occupying a centered position wherein the gas chamber is isolated from both the gas pressure source and the atmosphere; a first operator connection (15) between the fuel pump output and the valve means for biasing the valve means toward a position in which the gas pressure source acts to pressurize the accumulator gas chamber; and a second operator connection (42*a*) between the gas chamber and the valve means for biasing the valve means toward a position in which the gas chamber is vented to atmosphere.

2. The system of claim 1: the valve means comprising a stationary housing, a valve element floatably positioned in the housing, a first compression spring biasing the valve element in the direction wherein the gas chamber communicates with the pressure source, and a second compression spring biasing the valve element in the direction wherein the gas chamber communicates with the atmosphere.

3. The system of claim 2: the first and second compression spring means having substantially the same force and rate.

4. The system of claim 3: the stationary housing having a first central gas chamber port, a second atmospheric vent port spaced from the central port in one direction, and a third gas pressure port spaced from the central port in the other direction; the second and third ports being spaced from one another so that substantial spring compression takes place before the gas chamber port communicates with either one of the other ports.

5. The system of claim 4: the valve element comprising a piston having an annular flow groove in continual communication with the central gas chamber port, said annular groove having an axial length substantially less than the spacing between the second and third ports.

6. The system of claim 1: the valve means comprising a stationary housing defining a slide axis, said housing having a first central port communicating with the gas chamber, a second vent port spaced from the central port in one direction along the slide axis, a third gas pressure port communicating with the gas pressure source and spaced from the central port in the opposite direction along the slide axis; a piston valve element slidably positioned in the housing for traversing movement across the three ports; said piston having an annular groove communicating with the central gas port, the annular groove having an axial length substantially less than the spacing between the second and third ports; a first compression spring entrained between one end of the piston and the housing for biasing the piston toward a position wherein the annular groove communicates the central port with the third gas pressure port; a second compression spring trained between the other end of the piston and the housing for biasing the piston toward a position wherein the annular groove communicates the central port with the second vent port; the aforementioned operator connections comprising a first conduit connecting the fuel pump output line with the housing space at said one end of the piston, and a second conduit connecting the accumulator gas chamber with the housing space at said other end of the piston.

* * * * *